United States Patent [19]

Sawada et al.

[11] Patent Number: 4,627,412

[45] Date of Patent: Dec. 9, 1986

[54] LIQUID FUEL COMBUSTION APPARATUS

[75] Inventors: Katsuji Sawada; Yoshiaki Kimijima; Hidetoshi Umehara, all of Tochigi, Japan

[73] Assignee: Mikuni Kogyo Kabushiki Kaisha, Tokyo, Japan

[21] Appl. No.: 726,685

[22] Filed: Apr. 24, 1985

[51] Int. Cl.[4] ..... F24H 3/06

[52] U.S. Cl. ..... 126/110 B; 126/116 R; 237/12.3 C

[58] Field of Search ..... 126/110 B, 116 R; 431/158, 173, 182, 183, 185, 260, 353; 237/12.3 C

[56] References Cited

U.S. PATENT DOCUMENTS

| | | | |
|---|---|---|---|
| 2,757,662 | 8/1956 | Baier et al. | 126/110 B |
| 2,780,218 | 2/1957 | Allen | 126/110 B |
| 3,103,923 | 9/1963 | Kofink | 431/173 X |

FOREIGN PATENT DOCUMENTS

| | | | |
|---|---|---|---|
| 3136839 | 3/1983 | Fed. Rep. of Germany | 237/12.3 C |
| 5685 | of 1962 | Japan . | |

*Primary Examiner*—Margaret A. Focarino

*Attorney, Agent, or Firm*—Pahl, Lorusso & Loud

[57] ABSTRACT

An improved vaporized liquid fuel combustion apparatus of the type including a cylindrical combustion chamber, a blower and a heat exchanger is disclosed. An end plate located at the upstream end of the combustion chamber is formed with an air flow guide port through which combustion air is introduced into the combustion chamber. The air flow guide port is located at a position eccentric relative to the axis of the cylindrical combustion chamber. An air guide is disposed in the area located in the proximity of the air flow guide port in such a manner to generate swirl flow in the combustion chamber. The air guide may be disposed on the wall surface of the end plate either on the side located opposite to the blower casing or on the side located opposite to the combustion chamber. The air guide is preferably formed integral with the end plate by press working. To generate swirl flow a swirl flow generating air passage in the form of a circular groove may be formed in the blower casing so that air from the blower is brought to the air flow guide port in the swirled state. The swirl flow generating passage is so designed that its depth as measured from the bottom gradually decreases toward the air flow guide port on the end plate.

11 Claims, 11 Drawing Figures

FIG. 2
(PRIOR ART)
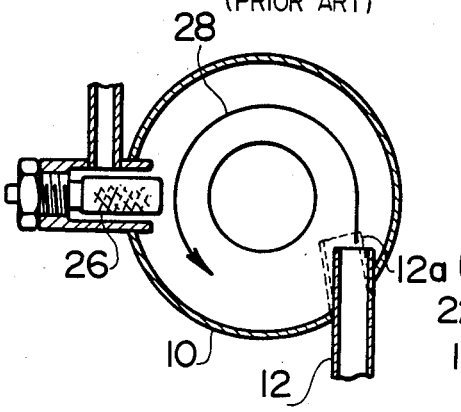
FIG. 1
(PRIOR ART)
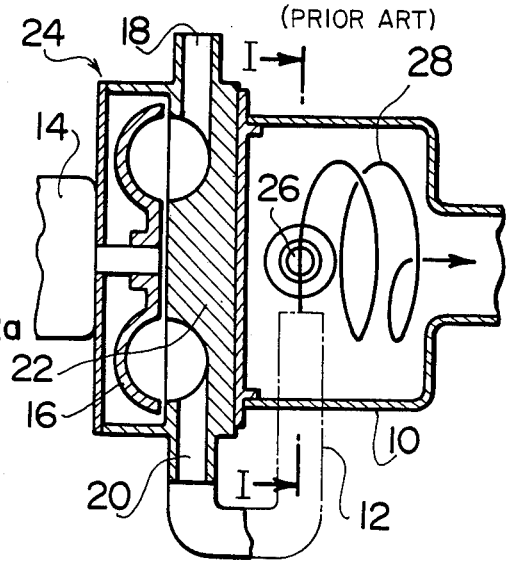
FIG. 4
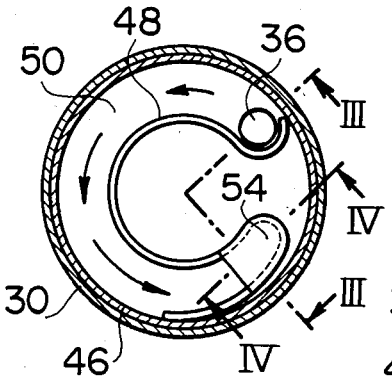
FIG. 3
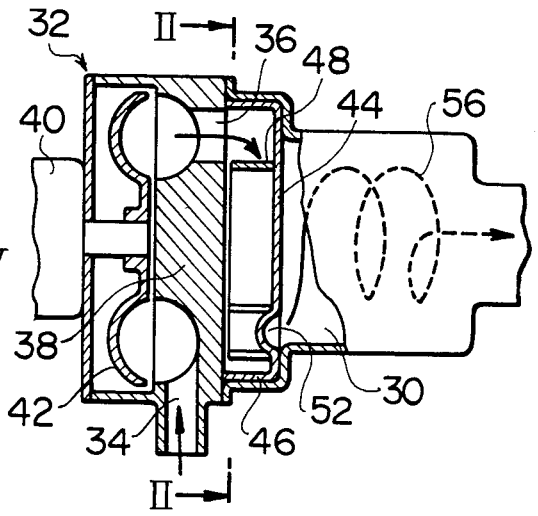
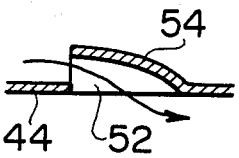
FIG. 5

FIG. 6
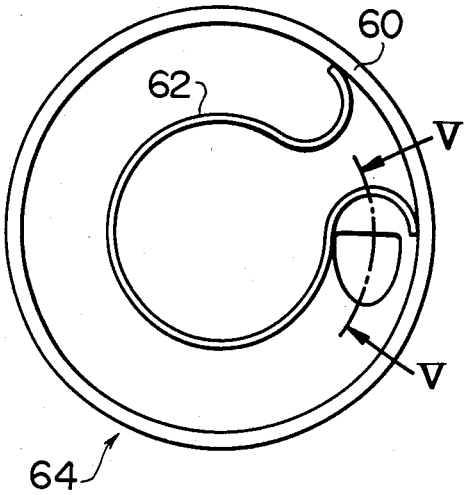
FIG. 7
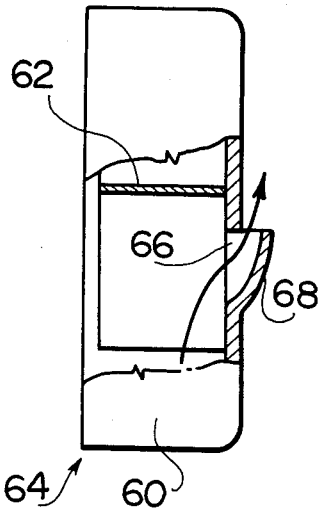
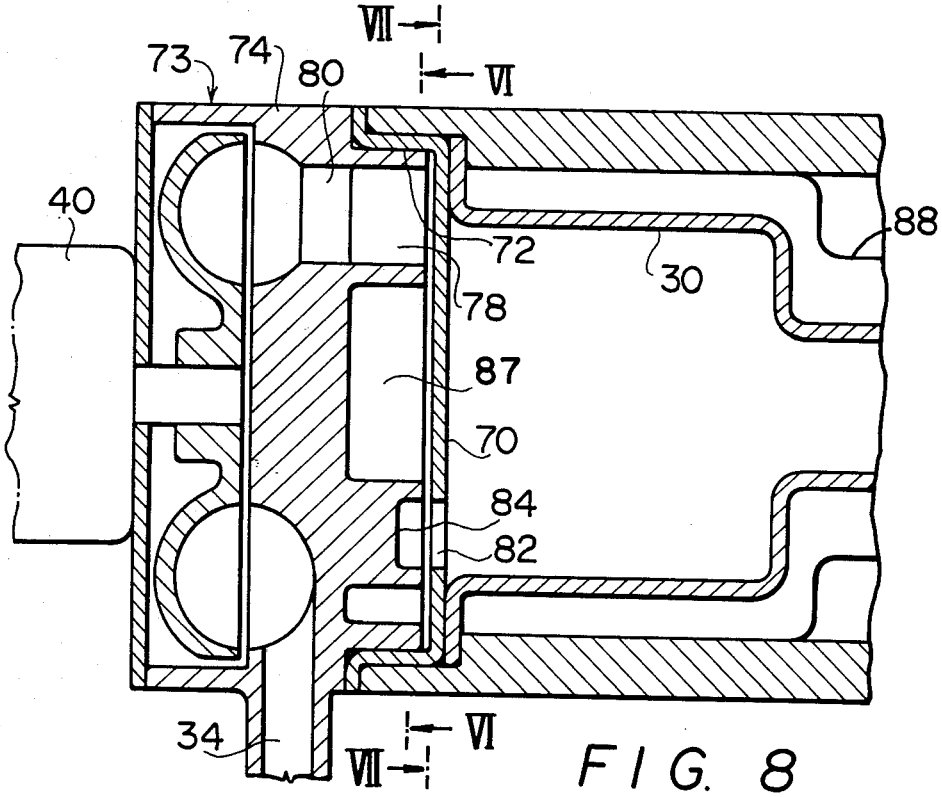
FIG. 8

LIQUID FUEL COMBUSTION APPARATUS

BACKGROUND OF THE INVENTION

1. Field of the Invention

The present invention relates to a liquid fuel combustion apparatus and more particularly to improvement of or relating to a vaporized liquid fuel combustion apparatus of the type including a cylindrical combustion chamber in which liquid fuel is burnt to generate combustion gas, a blower for supplying combustion air into the cylindrical combustion chamber through a swirl flow guide port on the end plate disposed at the upstream end of the cylindrical combustion chamber and a heat exchanger by means of which thermal energy in the combustion chamber is transmitted to fluid to be heated so that the thus generated combustion gas flows forwardly in a swirled pattern through the cylindrical combustion chamber.

2. Description of the Prior Art

As is well known, a conventional vaporized liquid fuel combustion apparatus designed in smaller dimensions to achieve combustion under high operative load is adapted to generate swirl in the cylindrical combustion chamber for the purpose of improving combustion efficiency. To meet the requirement for improved combustion efficiency the conventional vaporized liquid fuel combustion apparatus is equipped with an air supplying tube disposed at a position eccentric relative to the axis of the cylindrical combustion chamber so as to allow combustion air to be supplied into the latter through the air supplying tube.

To facilitate understanding of the present invention a typical conventional vaporized liquid fuel combustion apparatus will be described below with reference to FIGS. 1 and 2.

As is apparent from the drawings, an U-shaped combustion air supplying tube 12 is attached to the cylindrical combustion chamber by welding in such a manner that the one end communicates with the discharge port of the blower and the other end projects inwardly of the cylindrical wall of the combustion chamber 10. As the blower 24, including motor 14, a rotor 16 driven by the former and a casing 22 with an air suction port 18 and air discharge port 20 formed thereon, is driven, combustion air is introduced into the cylindrical combustion chamber 10 via the air supplying tube 12. An ignition plug 26 is fixedly secured to the cylindrical combustion chamber 10. By virtue of arrangement of the combustion air supplying tube 12 made in the illustrated manner, a swirl as identified by a spiral line 28 in FIG. 1 is produced in the cylindrical combustion chamber 10. It has been often found with the conventional liquid fuel combustion apparatus that when the combustion air supplying tube 12 is incorrectly attached to the cylindrical combustion chamber 10, that is, when it is attached to the cylindrical wall of the combustion chamber as illustrated by dotted lines in FIG. 2, there takes place abnormality with respect to generation of swirl 28, resulting in poor combustion performance by the apparatus.

Other disadvantageous features of the conventional apparatus are that complicated welding tools and jigs and highly trained welding technique are required for carrying out uniform welding at the position where the end part of the combustion air supplying tube 12 is attached to the cylindrical wall of the combustion chamber 10 while the direction of projection of the combustion air supplying tube 12 into the interior of the combustion chamber 10 is correctly determined and moreover it is very difficult to achieve uniform welding to such a high level that there occurs no fluctuation in respect of combustion performance of the apparatus.

SUMMARY OF THE INVENTION

Thus, the present invention has been made with the foregoing background in mind and its object resides in providing an improved vaporized liquid fuel combustion apparatus of the earier mentioned type which assures excellently high reliability with respect to combustion performance without any necessity for complicated welding tools and jigs and highly trained welding technique.

Another object of the present invention is to provide an improved vaporized liquid fuel combustion apparatus of the earlier mentioned type which requires a reduced number of man-hours for manufacturing the apparatus with high dimensional accuracy and therefore can be manufactured at an inexpensive cost.

To accomplish the above objects there is proposed according to one aspect of the invention a vaporized liquid fuel combustion apparatus of the type including a cylindrical combustion chamber in which liquid fuel is burnt to generate combustion gas, a blower for supplying combustion air into the cylindrical combustion chamber and a heat exchanger by means of which thermal energy in combustion gas is transmitted to fluid to be heated, wherein the improvement consists in that an end plate located at the upstream end of the cylindrical combustion chamber is formed with a swirl flow guide port through which combustion air delivered from the blower is introduced into the cylindrical combustion chamber, the swirl flow guide port being located at a position eccentric relative to the axis of the cylindrical combustion chamber, and an air guide is disposed in the area located in the proximity of the swirl flow guide port to correctly guide the flow of combustion air to be introduced into the cylindrical combustion chamber via the swirl flow guide port.

The air guide is normally disposed on the wall surface of the end plate on the side located opposite the cylindrical combustion chamber. Alternatively, it may be disposed on the wall surface of the end plate on the side exposed to the interior of the cylindrical combustion chamber.

Preferably, the air guide is formed integral with the end plate by press working.

Further, there is proposed according to other aspect of the invention a vaporized liquid fuel combustion apparatus of the type including a cylindrical combustion chamber in which liquid fuel is burnt to generate combustion gas, a blower for supplying combustion air into the cylindrical combustion chamber and a heat exchanger by means of which thermal energy in the combustion gas is transmitted to the fluid to be heated, wherein the improvement consists in that an end plate located at the upstream end of the cylindrical combustion chamber is formed with a swirl flow guide port through which combustion air delivered from the blower is introduced into the cylindrical combustion chamber, the swirl flow guide port being located at a position eccentric relative to the axis of the cylindrical combustion chamber, and a swirl flow generating air passage in the form of a circular groove is formed in the blower casing so as to allow combustion air to be delivered in a swirling flow pattern to the swirl flow guide port.

Preferably, the swirl flow generating air passage is so designed that its depth gradually decreases toward the swirl flow guide port on the end plate.

Other objects, features and advantages of the present invention will become more clearly apparent from a reading of the following description which has been prepared in conjunction with the accompanying drawings.

BRIEF DESCRIPTION OF THE DRAWINGS

The accompanying drawings will be briefly described below.

FIG. 1 is a sectional view of a conventional vaporized liquid fuel combustion apparatus.

FIG. 2 is a cross-sectional view of the apparatus taken in line I—I in FIG. 1.

FIGS. 3 and 5 schematically illustrate a vaporized liquid fuel combustion apparatus according to a first embodiment of the invention.

FIG. 3 is a sectional view of the apparatus of the invention taken in line III—III in FIG. 4.

FIG. 4 is a cross-sectional view of the apparatus taken in line II—II in FIG. 3.

FIG. 5 is a fragmental enlarged sectional view of the apparatus taken in line IV—IV in FIG. 4.

FIGS. 6 and 7 schematically illustrate the apparatus according to a second embodiment of the invention, particularly illustrating the structure of an end plate.

FIG. 6 is a front view of the end plate.

FIG. 7 is a fragmental enlarged sectional view of the end plate taken in line V—V in FIG. 6.

FIGS. 8 to 11 schematically illustrate the apparatus according to a third embodiment of the invention.

FIG. 8 is a sectional view of the apparatus.

FIG. 9 is a cross-sectional view of the apparatus taken in line VI—VI in FIG. 8.

FIG. 10 is a cross-sectional view of the apparatus taken in line VII—VII in FIG. 8, and FIG. 11 is a fragmental enlarged sectional view of the rotor casing taken in line VIII—VIII in FIG. 9.

DESCRIPTION OF THE PREFERRED EMBODIMENTS

Figure 9:
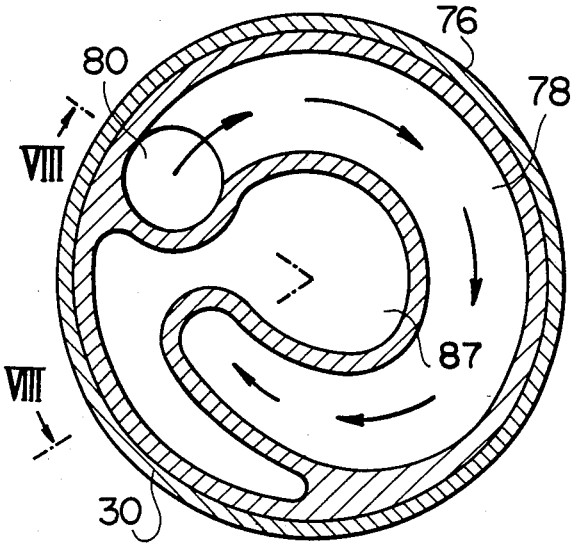
Figure 10:
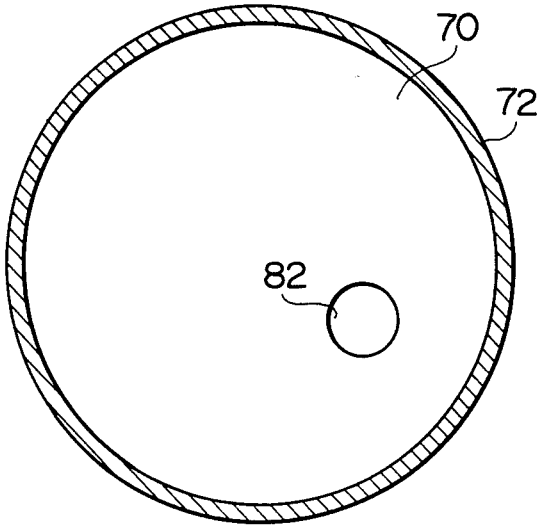

Now, the present invention will be described in a greater detail hereunder with reference to FIGS. 3 to 11.

First, description will be made as to a liquid fuel combustion apparatus according to the first embodiment of the invention with reference to FIGS. 3 to 5.

As illustrated in FIGS. 3 and 4, a blower 32 for supplying combustion air toward the cylindrical combustion chamber 30 includes a casing 38 with air suction port 34 and air delivery port 36 formed therein, a motor 40 and a rotor 42 adapted to be driven by the motor 40 to displace air from the air suction port 34 to the air delivery port 36. An end plate 44 of the combustion chamber 30 has a cylindrical skirt 46 of which outer peripheral portion extends in the leftward direction as seen in the drawing so that it is fitted into the casing 38 of the blower 32. Specifically, the end plate 44 is fixedly provided with a swirl flow guide 48 in the area located radially inwardly of the cylindrical skirt 46. The hollow space as defined between the cylindrical skirt 46 and the swirl flow guide 48 constitutes an air passage 50 having the circular configuration as is best seen in FIG. 4. The one end of the circular air passage 50 is located in alignment with the air delivery port 36, while the other end of the same is in communication with a swirl flow guide port 52 on the end plate 44.

As will be best seen FIG. 5, the end plate has an air guide 54 formed at the position located around the swirl flow guide port 52 so as to allow combustion air to easily flow through the swirl flow guide port 52. The air guide 54 is designed in such a configuration that the direction of flow of combustion air into the combustion chamber 30 has a predetermined angle relative to the end plate 44 and moreover the direction of flow of combustion air has a circumferential component relative to the same. By virtue of such an arrangement, swirl flow as identified by the dotted line in the drawing is generated in the combustion chmaber 30, resulting in improved combustion performance of the apparatus.

In the illustrated embodiment the air guide 54 is integrally formed from the end plate 44 by pressing operation. Alternatively, it may be secured to the end plate 44 at the position located opposite to the swirl flow guide port 52 on the latter by welding or the like process. In this case securing of the air guide 54 to the end plate 44 does not require any highly trained welding technique and it can be achieved by using simple tools and jigs. Thus, the combustion chamber 30 has high reliability with respect to combustion performance. It will be obvious that the air guide 52 can be formed at the same time the swirl flow guide port 52 is formed on the end plate 44 by press working (see FIG. 5).

In the embodiment as illustrated in FIGS. 3 to 5 the air guide 54 on the end plate 44 is projected in the opposite direction relative to the combustion chamber 30. Alternatively, it may be projected toward the combustion chamber 30 without any loss in combustion performance and press working.

Next, description will be made below as to the apparatus according to the second embodiment of the invention with reference to FIGS. 6 and 7.

In this embodiment the apparatus includes an end plate 64 of which outer peripheral extension constitutes a skirt 60 and a swirl flow guide 62 is fixedly secured to the inner wall of the skirt 60. Further, the end plate 64 is formed with a swirl flow guide port 66. As is apparent from the drawings, an air guide 68 for determining the direction of flow of combustion air is projected in the opposite direction relative to the skirt 60 at the position located around the swirl flow guide port 66. Arrangement of the apparatus made in the abovedescribed manner assures substantially the same combustion performance as in the case of the first embodiment and has an advantageous feature of reduced man-hours required for manufacturing the apparatus.

Next, description will be made as to how air flows in the apparatus as constructed in the above-described manner.

As the blower 32 is driven, air is sucked therein through the air suction port 34 and it is then blown out of the air discharge port 36 so that it is brought to the swirl flow guide port 52 via the air passage 50. In the case where the air guide 54 is disposed leftwardly of the end plate 44 as seen in FIG. 3, the direction of flow of combustion air is predetermined before it flows through the swirl flow guide port 52. On the other hand, in the case where the air guide 68 is disposed rightwardly of the end plate 64 as seen in FIG. 7, the direction of flow of combustion air is determined after it flows through the swirl flow guide port 66 so as to generate swirl 56 in the combustion chamber 30.

Since swirl 56 is generated in the combustion chamber 30 without occurrence of fluctuation in flowing state from apparatus to apparatus owing to uniformity from the viewpoint of manufacturing of the apparatus, excellently high combustion performance is assured for each of the apparatuses thus manufactured.

Another advantageous feature of the present invention is that an apparatus having higher reliability in respect of combustion performance can be manufactured by improved manufacturing accuracy.

Another advantageous feature of the present invention is that the welding operation is easily conducted for the area where combustion air is introduced into the combustion chamber or no welding operation is required, resulting in a reduced number of man-hours required for manufacturing the apparatus and reduced manufacturing cost.

Figure 11:
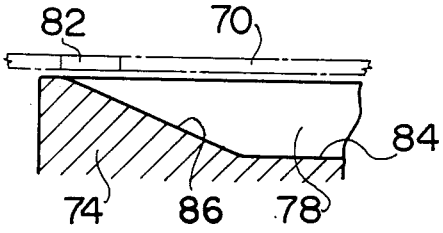

Next, description will be made below as to the apparatus according to the third embodiment of the invention with reference to FIGS. 8 to 11. It should be noted that same or similar parts and components in the drawings as those in FIGS. 1 to 7 are identified by the same reference numerals In this embodiment the combustion chamber 30 includes an end plate 70 at the lefthand end of which outer peripheral portion constitutes a skirt 72. The casing 74 of a blower 73 is produced by a diecasting process and the righthand end outer wall portion 76 of the casing 74 as seen in the drawing is so dimensioned that it is closely fitted into the skirt 72 of the end plate 70. Further, the casing 74 is formed with an air passage 78 having a circular configuration on its righthand side surface located facing the end plate 70 so that the one end of the air passage 78 is located in alignment with an air discharge port 80 and the other end of the same is located in alignment with a swirl flow guide port 82 on the end plate 70. As will be apparent from FIG. 11, the air passage 78 is so designed that its depth as measured from the bottom 84 gradually decreases from the position in the proximity of the air discharge port 80 to the other end of the air passage 78. Alternatively, as illustrated in FIG. 11, the air passage 78 may have an inclined surface 86 in the area located opposite to the swirl flow guide port 82 of the end plate 70, the inclined surface 86 extending downwardly at a certain acute inclination angle to be jointed to the bottom 84 of the air passage 78, so that combustion air flows into the combustion chamber 30 at the same inclination angle relative to the end plate 70.

To reduce weight of the casing 74 and spare material required for the latter, a cavity 87 is formed on the righthand side surface of the casing 74 while a partition is defined between the cavity 87 and the circular air passage 78.

Next, description will be made below as to how air flows in the apparatus of the invention.

As the blower 73 is driven by the motor 40, air is sucked through the air suction port 34 and pressurized air is discharged from the air discharge port 80. Thereafter, it is introduced into the combustion chamber 30 via the air passage 78 and the swirl flow guide port 82 so that swirl is generated in the combustion chamber 30. When gasified fuel is ignited, there is produced combustion gas at an elevated temperature in the combustion chamber 30 and thermal energy in the thus produced combustion gas is transmitted to fluid to be heated via the heat exchanger 88. After completion of heat exchanging between the combustion chamber 30 and the heat exchanger 88 combustion gas is discharged as exhaust gas through a discharge port which is not shown in the drawings.

Since the air passage 78 extending from the discharge port 80 of the blower 73 to the swirl flow guide port 82 of the end plate 70 is formed by a diecasting process, air flows through the combustion chamber 30 without any fluctuation from apparatus to apparatus due to variations in the manufacturing of the apparatus. Accordingly, each apparatus has excellently high reliability in respect of combustion performance.

As will be readily apparent from the above description, in the present invention the air passage and the air guide are so modified that they are integrally simultaneously formed by a diecasting process at the same time the blower casing is formed, in contradistinction to the conventional structure that is formed or built by press working, plate welding or the like process. Several advantageous features of the apparatus of the invention will be summarized below.

(1) remarkable reduction in the number of parts or components constituting the apparatus and the number of man-hours required for manufacturing the same, enabling the apparatus to be manufactured at an inexpensive cost.

(2) improved dimensional accuracy attributable to employment of the diecasting process, resulting in excellently high uniformity of quality of the apparatus.

While the present invention has been described above with respect to a few preferred embodiments thereof, it should of course be understood that it should not be limited only to them and that various changes or modifications may be made in any acceptable manner without departure from the spirit and scope of the invention as defined by the appended claims.

What is claimed is:

1. In a vaporized liquid fuel combustion apparatus of the type including:

a cylinder defining a combustion chamber, said cylinder having an inlet end for receipt of combustion air and an outlet end for exhausting gaseous combustion products;

an end plate covering said inlet end of said cylinder;

a blower, including a rotor and a casing, for supplying combustion air to said combustion chamber, the improvement comprising:

a discharge port, formed in said end plate, for discharging air from the blower into the combustion chamber, said discharge port being offset with respect to the longitudinal axis of said combustion apparatus; and air deflector means for causing the air to exit said discharge port at an acute angle with respect to said end plate, said air deflector means defining a surface inclined at an acute angle with respect to said end plate, said inclined surface covering said discharge port.

2. A combustion apparatus in accordance with claim 1 wherein said air deflector means depends from the surface of said end plate opposite said combustion chamber.

3. A combustion apparatus in accordance with claim 1 wherein said air deflector means depends from the surface of said end plate facing said combustion chamber.

4. A combustion apparatus in accordance with claim 1 wherein said air deflector means is formed integral with said end plate by pressing.

5. A combustion apparatus in accordance with claim 1 wherein the end plate is provided with a cylindrical skirt depending from its periphery and spacing said end plate from the blower casing, said skirt defining a hollow space between said end plate and the blower casing, said combustion apparatus further comprising air flow guide means within said hollow space for providing a spiral flow path for the combustion air en route from the blower to the discharge port.

6. A combustion apparatus in accordance with claim 1 wherein said inclined surface is formed as a groove in the blower casing.

7. In a vaporized liquid fuel combustion apparatus of the type including:

a cylinder defining a combustion chamber, said cylinder having an inlet end for receipt of combustion air and an outlet end for exhausting gaseous combustion products;

an end plate covering said inlet end of said cylinder;

a blower for supplying combustion air to said combustion chamber, said blower including a rotor, a casing and a first discharge port in the casing;

wherein the improvement comprises:

a second discharge port, formed in said end plate, for discharging air from the blower into the combustion chamber, said first and second discharge ports being offset with respect to the longitudinal axis of said combustion chamber; and air flow guide means for providing a spiral flow path for the combustion air en route from said first discharge port to said second discharge port.

8. A combustion apparatus in accordance with claim 7 wherein said air flow guide means includes a circular groove in the surface of said casing facing said end plate.

9. A combustion apparatus in accordance with claim 8 wherein the depth of said groove gradually decreases from said first discharge port toward said second discharge port.

10. A combustion apparatus in accordance with claim 8 wherein the bottom surface of said groove covering said second discharge port is formed with a surface inclined at an acute angle with respect to said end plate.

11. A combustion apparatus in accordance with claim 8 wherein said end plate has a cylindrical skirt portion depending from its periphery and said casing has a peripheral portion contoured to mate with the interior of said skirt portion.

* * * * *